United States Patent [19]

Tegel

[11] Patent Number: 4,805,781

[45] Date of Patent: Feb. 21, 1989

[54] STAND FOR DISPLAYING SPECTACLES OR SPECTACLE FRAMES

[76] Inventor: Christiaan J. Tegel, Wijnoldy Daniëlslaan 37, 2082 HB Santpoort, Netherlands

[21] Appl. No.: 51,948

[22] Filed: May 19, 1987

[30] Foreign Application Priority Data

May 23, 1986 [NL] Netherlands ..... 8601326

[51] Int. Cl.[4] ..... A47F 7/02

[52] U.S. Cl. ..... 211/13; 211/4; 211/1.5; 211/8; 248/DIG. 2

[58] Field of Search ..... 211/4, 8, 13, 1.5; 248/551, DIG. 2

[56] References Cited

U.S. PATENT DOCUMENTS 3,326,385 6/1967 Pinkerton et al. ..... 211/4
4,558,788 12/1985 Grothaus ..... 211/13

FOREIGN PATENT DOCUMENTS 2562637 5/1986 France .
2024003 1/1980 United Kingdom .
2159567 12/1985 United Kingdom .

*Primary Examiner*—Robert W. Gibson, Jr.
*Attorney, Agent, or Firm*—Dressler, Goldsmith, Shore, Sutker & Milnamow, Ltd.

[57] ABSTRACT

Stand for displaying spectacles or spectacle frames. The stand comprises a movable part (2) comprising outwards protruding elements, extending in general perpendicular to the direction of movement and running through slots in the fixed frame part (1) of the stand. These protruding elements can cooperate with protruding elements of the frame part such that they determine a number of eye configurations each encompassing the bridge section of one of the displayed spectacles. The stand comprises furthermore an electrically driven moving mechanism for moving the movable part, either to a first extreme position or to a second extreme position, said moving mechanism being controllable by authorized persons using a remote control panel.

7 Claims, 3 Drawing Sheets

STAND FOR DISPLAYING SPECTACLES OR SPECTACLE FRAMES

The invention relates to a stand for spectacles or spectacle frames, with means to protect these spectacles or spectacle frames against theft, comprising a first fixedly positioned construction part, a second construction part which can be moved over a predetermined distance along said first construction part between two extreme positions, said second construction part comprising outwards protruding elements, extending in general perpendicular to the direction of movement and running through slots in the first construction part, the length of said slots being at least equal to said predetermined distance, which protruding elements in the first extreme position of said second construction part are at least partly contacting elements of the first construction part, determining thereby a number of eye configurations each encompassing the bridge section of one of the displayed spectacles or spectacle frames and in the other extreme position of the second construction part are at a distance of said elements of the first construction part in such a manner that the spectacles or spectacle frames can be removed from the display stand.

Such a stand is described in the U.K. patent application GB No. 2,024,003. This prior art stand comprises a cylinder lock connected to an elongated arm which is positioned such that in the one position of said arm the second construction part of the stand is locked into the first position whereas, after operating the cylinder lock with a key and moving said elongated arm to a radially different position, the second construction part can be moved to the other extreme position. As appears from page 2, lines 37–41 of said publication this movement is obviously carried out by hand, specifically by raising one of a number of protruding arms.

The use of keys by authorized personal is considered a disadvantage, because said personnel finds it very inconvenient to use such keys. Furthermore the actual movement of the second construction part by hand is uncomfortable and considered as a disadvantage.

The object of the invention is now to provide an improved stand for displaying spectacles or spectacle frames.

In agreement with said object a stand of the type described above is in agreement with the invention characterized in that the stand comprises an electrically driven moving mechanism for moving the second construction part, either to the first extreme position or to the second extreme position, said moving mechanism being controllable by authorized persons using a control panel.

By providing an electrically driven moving mechanism for moving the second construction part controlled by a separate control panel all the above mentioned disadvantages are eliminated.

According to a preferred embodiment the moving mechanism comprises a drive motor with reduction gear installed at a fixed position in relation to the first construction part, the outgoing shaft of the reducing gear being coupled to a crank mechanism of which the output shaft is positioned into a slot extending in the second construction part perpendicular to the direction of movement of said second construction part, such that activation of the drive motor through the control panel will result into a movement of the second construction part in the direction of the first or the second extreme position.

According to a further preferred embodiment the radial distance between the outgoing shaft of the reduction gear and the output shaft of the crank mechanism corresponds with one half of the predetermined distance.

Specifically this last mentioned embodiment has the advantage that because of the mechanical cooperation between the crank mechanism coupled on the one hand to the drive motor and coupled on the other hand to the second construction part, this second construction part is mechanically locked both in the first extreme position as well as in the second extreme position. That implies that no further means are necessary to prevent unwanted movement of said second construction part once one of the extreme positions is reached.

The invention will now be explained in detail with reference to the embodiment illustrated in the attached drawings.

Figure 1:
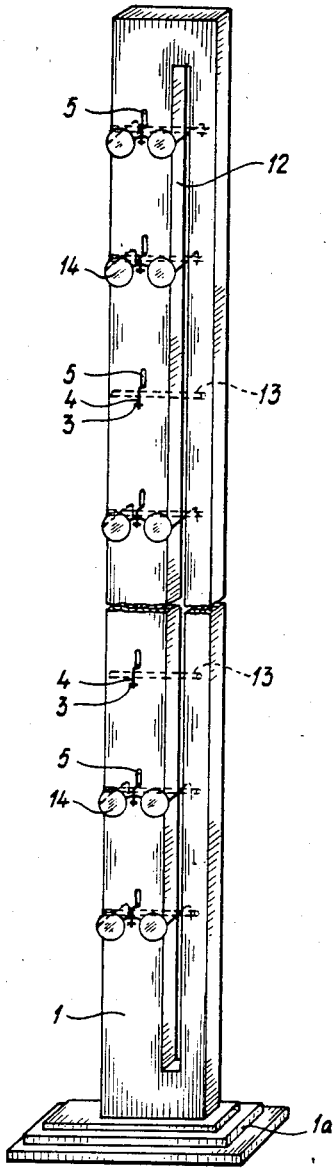
FIG. 1 illustrates a schematic front view of a stand according to the invention.
Figure 2:
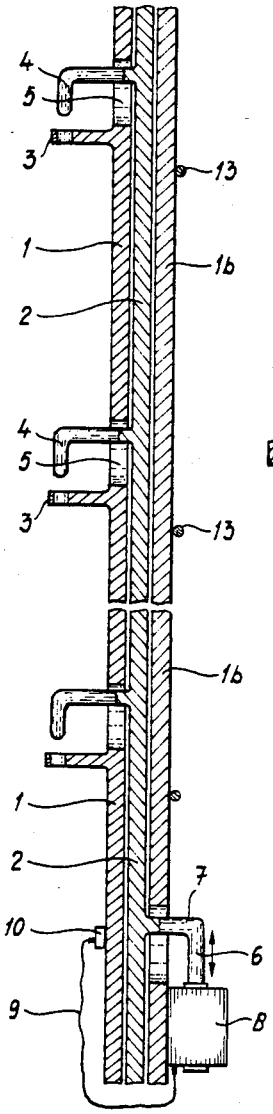
FIG. 2 illustrates a side view cross section of the stand according to FIG. 1.

In the Figures the first construction part is referenced by 1, the second construction part is referenced by 2. In the illustrated embodiment the first construction part is made with an in general U-shaped profile and positioned onto a foot piece 1*a*. A flat strip shaped bolt 2 is movably contained within the U-shaped profile and embodies the second construction part of the stand. A number of protruding elements 3 are attached to the construction part 1 and a number of protruding elements 4 are attached to the bolt 2. The open back side of the U-shaped construction part 1 is in this embodiment closed by means of a cover plate 1*b*, which, however, is not of any interest in relation to the invention.

The bolt 2 is movable within the construction part 1 over a predetermined distance both upwards and downwards, activated for instance by a magnetic switch 8. The movable core 6 of this magnetic switch 8 is connected to an extending strip 7 connected to the bolt 2. If the magnetic switch 8 is activated to its one stable position, then the bolt 2 will move downwards to the first extreme position; activating the magnetic switch 8 in the counter direction will result into an upwards movement of the bolt 2 to the other extreme position. In said one extreme position the elements 3 and 4 are cooperating in such a way that they determine together an eye configuration, whereas in the other extreme position the related elements 3 and 4 have a mutual distance.

The magnetic switch 8 can be operated by the shop personnel for instance using an infrared remote control unit which is known as such. In this case the magnetic switch 8 is for instance through the schematically indicated line 9 connected to an infrared sensor 10. Furthermore means are installed in the switch 8 for detecting the sensor signals and for translating these signals in activation signals for the actual magnetic switch.

Furthermore it is possible to connect the magnetic switches with one or more control panels which can only be operated by authorized persons to select one or more of the stands for bringing these stands into a position in which the objects thereof can be removed.

Figure 3:
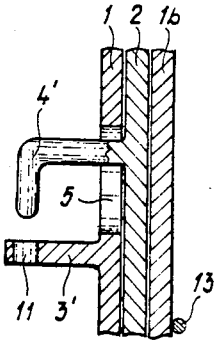
FIG. 3 illustrates a possible embodiment of the protruding elements attached to the respective construction part of the stand according to FIGS. 1 and 2.
Figure 4:
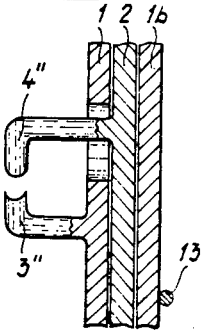
FIG. 4 illustrates an other possible shape of the protruding elements.

In FIGS. 3 and 4 possible embodiments of the protruding elements 3 and 4 are shown in more detail.

In FIG. 3 the protruding element 3' comprises a passage 11 in which one end of the protruding element 4' can penetrate. In the illustrated situation the eye configuration, determined by the elements 3' and 4', is not closed. If, however, the bolt 2 is moved downwards then the outer end of the element 4' will penetrate into the excavation 11' of the element 3' so that the eye will be closed.

In FIG. 4 the protruding element 4" comprises a rounded end whereas the protruding element 3" comprises a cup shaped end fitting onto the rounded end of element 4".

The stand comprises besides the already mentioned means a long slot 12 destined to receive one arm of each spectacle frame. The eye, determined by the protruding elements 3 and 4, grips around the bridge of the spectacle 14. Both arms of the spectacles are preferably resting onto a transversal rod 13, which transversal rods are at the correct height attached at the back side of construction part 1. By displaying the spectacles in this manner the buyer is able to inspect the spectacles from a very short distance without having the possibility to remove the spectacles from the stand, unless by controlling the bolt 2 the elements 4 are removed from the elements 3.

Although above a moving mechanism comprising a magnetic switch is described, it is preferred to use a drive motor with further means, details of which are illustrated in the FIGS. 5, 6, 7 and 8.

Figure 5:
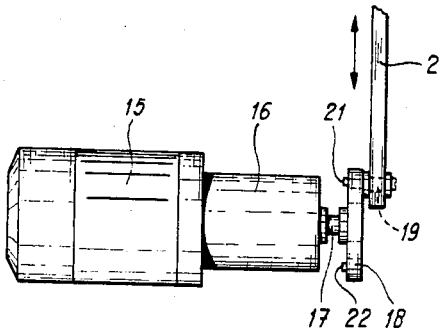
FIG. 5 illustrates an embodiment of the moving mechanism comprising a drive motor, reduction gear and crank mechanism.
Figure 6:
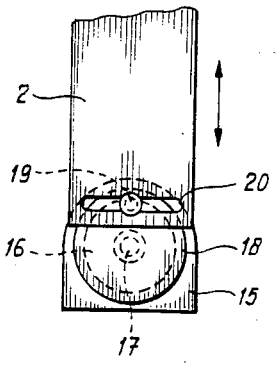
FIG. 6 illustrates a side view of FIG. 5.

FIG. 5 illustrates the electrically powered drive motor 15, coupled to a reduction gear 16. The outgoing shaft 17 of the reduction gear 16 is connected to a crank mechanism 18 with output shaft 19 extending through a slot 20 in the lower section of the second construction part 2 (see FIG. 6). The slot 20 extends perpendicular to the direction of movement of the second construction part 2.

It will be clear that by activating the drive motor 15 a rotation of the output shaft 19 of the crank mechanism 18 will be obtained through the reduction gear 16 resulting in an upwards or downwards movement of the second construction part 2. Preferably the length of the slot 20 is equal to twice the radial distance between the shaft 17 and the shaft 19. Under these circumstances the motor 15 only needs to be driven in one rotational direction and to be stopped at the correct position to bring the construction part 2 to the one or the other extreme position.

The rotational speed and the reduction ratio of the reduction gear 16 are preferably selected such that the rotational speed of the output shaft 19 of the crank mechanism 18 is in the order of about 30 revolutions pro minute so that the time to reach the second extreme position starting at the first extreme position or vice versa is in the order of 1 second.

Figure 7:
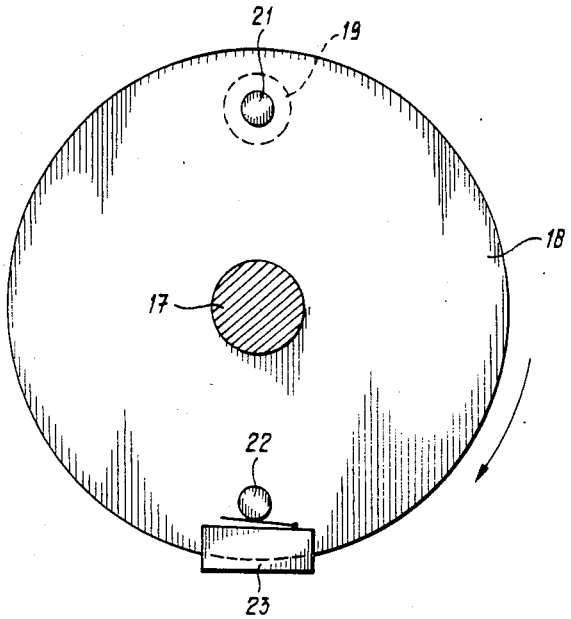
FIG. 7 illustrates details of the switch cooperating with the crank mechanism.

In this embodiment the crank mechanism 18 comprises two relatively small pins 21, 22, protruding from the backface of the crank plate 18 as is schematically illustrated in FIG. 5 and 7. These pins 21, 22 are cooperating with a microswitch 23 or a suitable switch of different type. Details of these switches are known to the expert in this field. The switch 23 is mounted at a fixed position. The switch is of the normally closed type and actuation by either the pin 21 or the pin 22 will bring the contacts of the switch to the open position.

Figure 8:
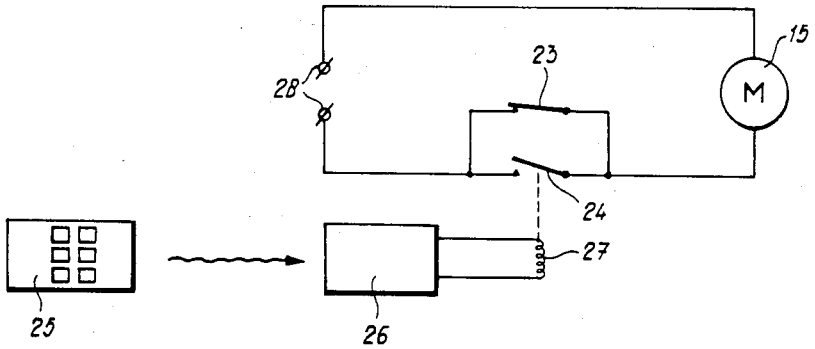
FIG. 8 illustrates a schematical diagram of the motor powering and control circuit.

FIG. 8 illustrates further details of the power and control circuit for the motor 15. The motor 15 is connected to the main terminals 28 through a parallel circuit comprising the normally closed contacts of the microswitch 23 and the normally opened contacts of a further magnetically controlled switch 24. The switch 24 is for instance part of a relay comprising furthermore the relay coil 27. The relay coil 27 can be activated by means of a receiver circuit 26. The receiver circuit 26 is for instance an infrared receiver, receiving signals from a hand-held transmitter 25. If the hand-held transmitter 25 transmits the correct code signals the receiver 26 will supply an activation signal to the coil 27 for closing the contacts 24.

If the second construction part 2 is moved to one of its two extreme positions then the switch 23 will be actuated so that the contact elements thereof are not contacting each other. Normally also the contact elements 24 will not be in contact with each other so that the motor 15 does not receive any drive current from the main terminals 28. However, if the construction part 2 has to be moved to the other extreme position a signal is generated by authorized personnel operating the transmitter 25 to transmit a suitable code signal to the receiver 26. The receiver 26 receives the code signal and supplies a current to the relay coil 27 for temporarily closing the contacts 24. As result thereof a motor 15 will start rotating. After a relatively short radial movement of the crank plate 18 the respective pin 21 or 22, until then actuating the switch 23, will be out of reach of the switch 23 with the result only contact elements of this switch 23 will move to the closed position bridging thereby the switch contacts 24 and maintaining a closed current path through the motor 15 irrespective of the position of the contact elements 24 which after a relatively short time will move back to the open position.

As soon as the crank plate 18 has moved over one half revolution the other actuation pin 21 or 22 will actuate the microswitch 23, interrupting thereby the current path through the motor 15 so that the motor will stop exactly at the moment in which the second construction part 2 has reached its other extreme position.

Details of ultraviolet receivers and transmitters for remote control purposes are considered within the reach of the expert in this field and therefore no further details will be provided.

It will be clear that various modifications and amendments of the described embodiments are conceivable without leaving the scope of the attached claims.

I claim:

1. A display stand for spectacles comprising:

a stationary body member having a plurality of slots formed in a front face thereof;

spectacle support members projecting from said front face adjacent said slots;

a locking bolt slidably mounted in said body member behind said front face;

spectacle locking members projecting forwardly from said bolt and through said slots;

said bolt being movable between a first position wherein said locking members cooperate with associated support members to prevent removal of spectacles retained therebetween and a second position wherein said locking members move away from associated support members to permit removal of retained spectacles; and electrically driven means for moving said bolt between said first and second positions, said means being controllable by authorized persons using a control panel.

2. A display stand according to claim 1 wherein the electrically driven means comprises a drive motor with a reduction gear fixedly installed with relation to said stationary body member, the reduction gear having an outgoing shaft coupled to a crank mechanism having an output shaft positioned in a slot in said locking bolt extending perpendicular to the direction of travel of said locking bolt so that activation of the drive motor through the control panel causes movement of said locking bolt between said first and second positions.

3. A display stand according to claim 2 wherein there is provided a drive motor activation circuit that comprises a first switch fixedly mounted such that said switch is operated by the crank mechanism or by said locking bolt when said locking bolt reaches said first and second positions.

4. A display stand according to claim 3 wherein the drive motor actuation circuit comprises a second remotely controlled switch bridging said first switch so that actuation of said second switch by means of the control panel causes activation of the drive motor.

5. A display stand according to claim 1 wherein the radial distance between the outgoing shaft of the reduction gear and the output shaft of the crank mechanism corresponds to one half of the travel distance of the locking bolt between said first and second positions.

6. A display stand according to claim 1 wherein the moving mechanism comprises a magnetic switch, the actuation coil thereof being connected to said locking bolt, said magnetic switch being controlled by said control panel.

7. A display stand according to claim 1 wherein the control panel is connected to an ultraviolet transmitter whereby signals can be transmitted to at least one ultraviolet receiver which in response thereto is adapted to activate the electrically driven moving mechanism.

* * * * *